United States Patent [19]

Biskis

[11] 4,213,300

[45] Jul. 22, 1980

[54] VARIABLE FLOW RATE CONTROL WITH MECHANICAL OVERRIDE FOR CLOSED CENTER VALVE

[75] Inventor: Kestutis Biskis, Downers Grove, Ill.

[73] Assignee: International Harvester Company, Chicago, Ill.

[21] Appl. No.: 5,049

[22] Filed: Jan. 22, 1979

[51] Int. Cl.[2] ..... F15B 11/20

[52] U.S. Cl. ..... 60/420; 60/422; 60/445; 60/494; 91/516

[58] Field of Search ..... 60/420, 422, 445, 484, 60/494, DIG. 10; 91/514, 516

[56] References Cited

U.S. PATENT DOCUMENTS

| | | | |
|---|---|---|---|
| 2,827,768 | 3/1958 | Ziskal et al. | 60/422 X |
| 3,279,172 | 10/1966 | Kudo et al. | 60/DIG. 10 |
| 3,770,007 | 11/1973 | Orth et al. | 137/501 |
| 3,979,908 | 9/1976 | Alderson | 60/422 |

*Primary Examiner*—Edgar W. Geoghegan

*Attorney, Agent, or Firm*—Douglas W. Rudy; Ronald C. Kamp; F. David AuBuchon

[57] ABSTRACT

An agricultural tractor is provided with a hitch and draft control system hydraulically related to a plurality of other hydraulic functions. The hydraulic fluid distribution is preferenced by a priority valve including a variable orifice in series with the hitch and draft control system. The variable orifice acts as a raise rate control device and also as a controlling member for a load sensing variable displacement pump.

2 Claims, 4 Drawing Figures

VARIABLE FLOW RATE CONTROL WITH MECHANICAL OVERRIDE FOR CLOSED CENTER VALVE

BACKGROUND OF THE INVENTION

1. Field of the Invention

This invention is a device for controlling the distribution of hydraulic fluid in implement control circuits of an agricultural tractor. More specifically, this invention is an improvement to a priority valve functioning to distribute fluid flow between a draft control valve and other hydraulic motors generally associated with implements attached to a farm tractor.

2. Description of the Prior Art

The priority valve body utilized in this invention is similar to valve bodies familiar in the draft control system in use by the assignee of this invention. The variable orifice and the priority spool are both completely new to this type of draft control valve however. Former embodiments were open center devices functionally different from this invention. There is no interchangeability between this invention and prior art devices familiar to the Applicant.

A flow control valve described in U.S. Pat. No. 3,770,007 entitled "Dual Direction Flow Control Valve" to Orth et al, one of the inventors also being the inventor of this invention, shows a variable orifice device that has a rotary member similar to this invention, but the similarity stops there.

Aslo U.S. Pat. No. 3,979,908 discloses a priority valve similar to the instant invention but depends on a relief valve to operate and therefore will not be able to maintain flow to a priority demand at all times as is possible with the instant invention.

SUMMARY OF THE INVENTION

A priority control valve includes a variable orifice and a priority spool in a common body arranged to work together and independent of each other. The priority control valve is used in a closed center flow and pressure compensated hydraulic system provided with a 300 psi standby pressure.

The variable orifice is in series with a draft control valve and will act as a raise rate control device for a tractor hitch and draft control system controlled by the draft control valve.

A linkage system incorporating inputs from the draft control valve and from a separate control in the tractor cab, which can be overriden by a positive control lever linkage, are provided to direct rotation of the rotary metering valve for the variable orifice to increase or decrease flow through the variable orifice. Thus, when the position control lever is placed in a full raise position, this linkage will override the raise rate control linkage and move the rotary metering valve to a position fully opening the variable orifice.

The linkage in the raise rate control also is provided with an adjustable stop for setting the minimum raise rate flow condition for the variable orifice.

The variable orifice also acts as one of several controlling members for the load sensing variable displacement pump, thus any pressure drop across the orifice is signaled back to the pump directing increased flow from the variable displacement pump.

The primary object of this invention is to provide a priority valve for use in a closed center hydraulic system.

Also an object of this invention is to provide a raise rate control valve for use in a tractor hitch system that functions in concert with a priority valve.

A further object of this invention is to provide a variable orifice providing a differential pressure signal that may be used to increase the displacement of a variable displacement pump supplying fluid throughout the system.

BRIEF DESCRIPTION OF THE DRAWING FIGURES

The invention is described in the following description, wherein.

DETAILED DESCRIPTION OF THE INVENTION

Figure 1:
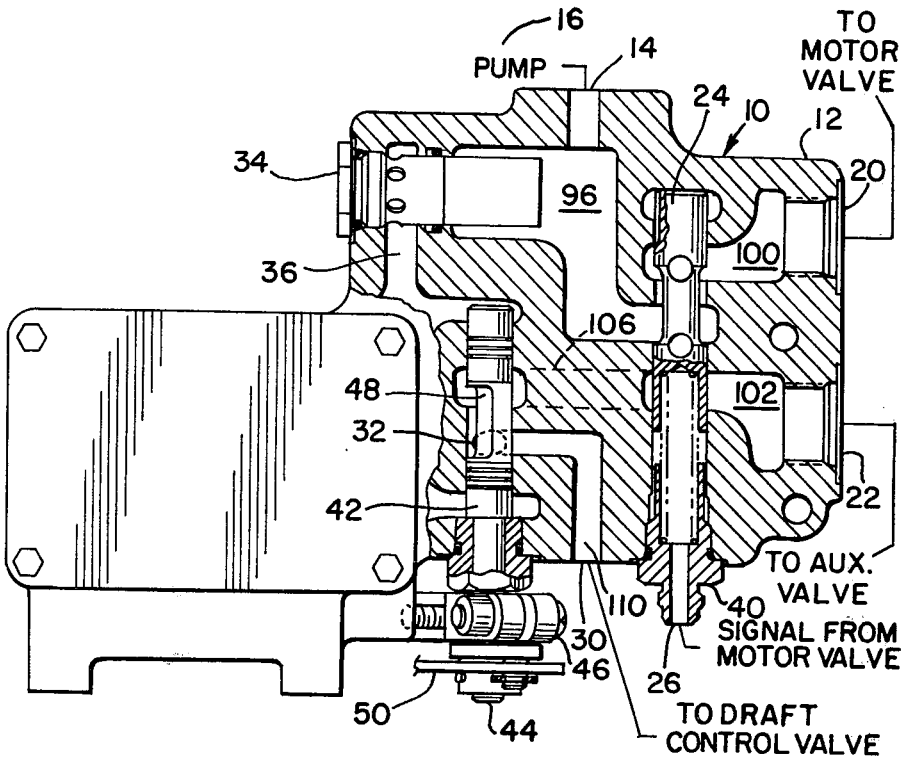
FIG. 1 is a top view of a priority valve assembly with portions broken away to reveal operating components.

Looking first at FIG. 1, which is the most informative of the views, the priority valve assembly is shown generally as 10 with the housing being 12. Fluid input to the housing is provided through inlet port 14 which is in communication with the variable displacement pump 16. Motor valve delivery port 20 and auxiliary valve delivery port 22 may receive fluid supplied by the pump 16 to various internal passages in the housing 12 based on the position of the priority valve spool 24.

Motor valve signal orifice 26 is provided and will allow access for a signal on the motor valve to affect the position of the priority valve spool 24.

Draft control delivery port 30 allows fluid access through the priority valve assembly and specifically through the variable orifice 32 to the draft control valve.

A high pressure relief valve 34 is provided in the assembly to relieve excessive pressure to passage 36 which is in communication with a reservoir which is not shown.

The priority valve spool 24 is urged by a spring 40 to the position shown in FIG. 1 at times when the variable displacement pump is not operating or when the motor valve requires fluid.

The rotary metering valve 42 is a multi-diametered rod with a threaded end 44 to which actuating arms 46 and 50 are attached. The rotary metering valve 42 is provided with an elongated flat 48 machined into its surface. The flat is rotatable across the variable orifice 32 such that the edge of the flat will dictate the orifice area as the rotary metering valve is rotated to an open position.

Figure 2:
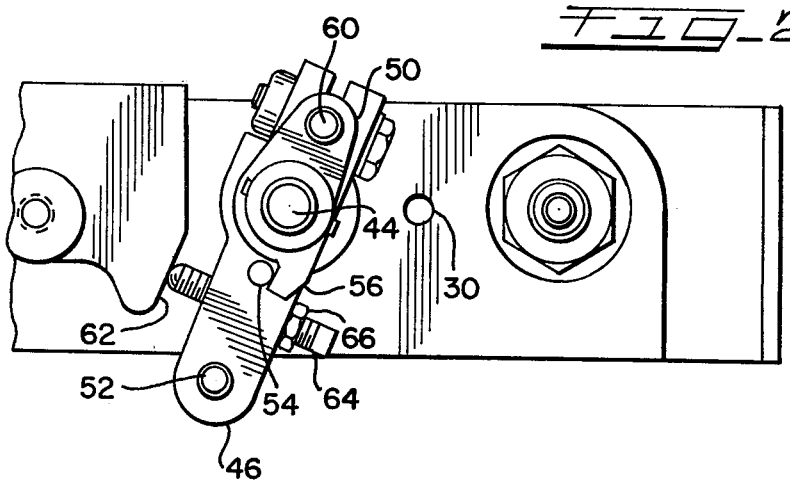
FIG. 2 is a side elevation view of a portion of the priority valve assembly.

The first actuating arm 46, best seen in FIG. 2, is inboard relative to the second actuating arm 50. A linkage accommodating aperture 52 is formed in the end of the arm while a stop pin 54 extends outwardly from the arm sufficiently far to contact the tab 56 extending from the second actuating arm 50. The second actuating arm 50 is also provided with a linkage receiving aperture 60.

The housing 12 is formed with a projecting flat 62 acting as a limit to restrict the arcuate movement of the rotary metering valve 42. An adjusting screw 64 with a locking nut 66 is threaded through the first actuating arm 46 to provide adjustment for the position of the rotary metering valve 42.

Figure 3:
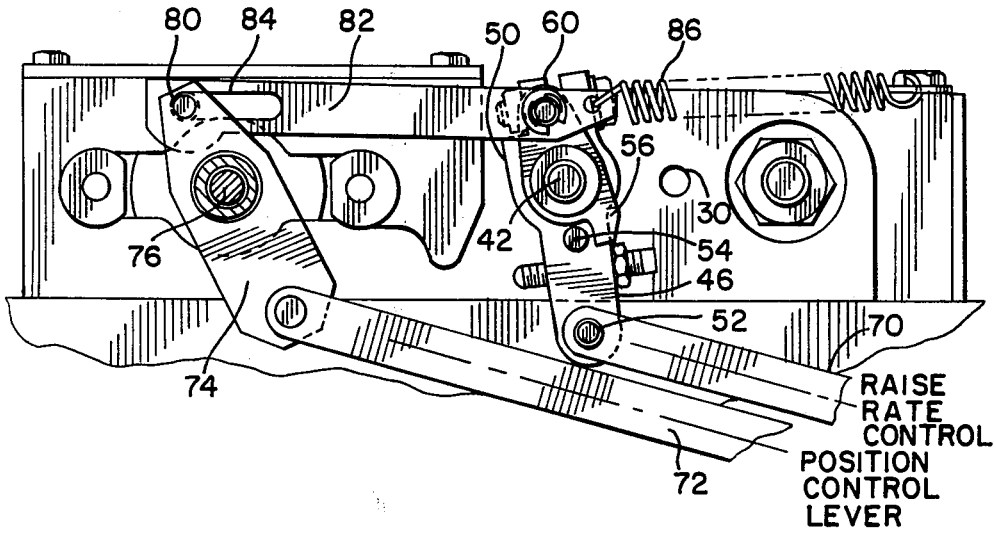
FIG. 3 is a side elevation view of a portion of a priority valve assembly including a portion of its associated operating linkage.

FIG. 3 shows the external linkages used to control the rotary metering valve 42. A raise rate control rod 70 extends from the vehicle cab to the linkage accommodating aperture 52 in the first actuating arm 46.

A position control rod 72 extends from the vehicle cab to lever arm 74 which is pivotable around pivot point 76. The lever arm is also linked, by projection 80, to a transverse linkage member 82 connected to the linkage receiving aperture 60 of the second actuating arm 50. The transverse linkage member is provided with an elongated aperture 84 which may allow limited independent movement of the position control rod 72. Spring 86 resists the counterclockwise displacement of the second actuating arm.

In FIG. 3 it can be seen that increasing the area of the variable orifice can be accomplished by movement of the raise rate control rod 70 irrespective of the position of the position control lever (rod 72) as the stop pin 54 on the first actuating arm 46 will contact the tab 56 on the second actuating arm. The elongated aperture 84 allows lateral movement of the transverse linkage member 82 when the raise rate control rod 70 moves the rotary metering valve counterclockwise.

The position control rod 72 will also be able to increase the opening area of the variable orifice as the second actuating arm 50 may move independently counterclockwise of the first actuating arm 46. Comparing FIGS. 2 and 3 relative to the linkage displacement views will clarify the understanding of this linkage.

Figure 4:
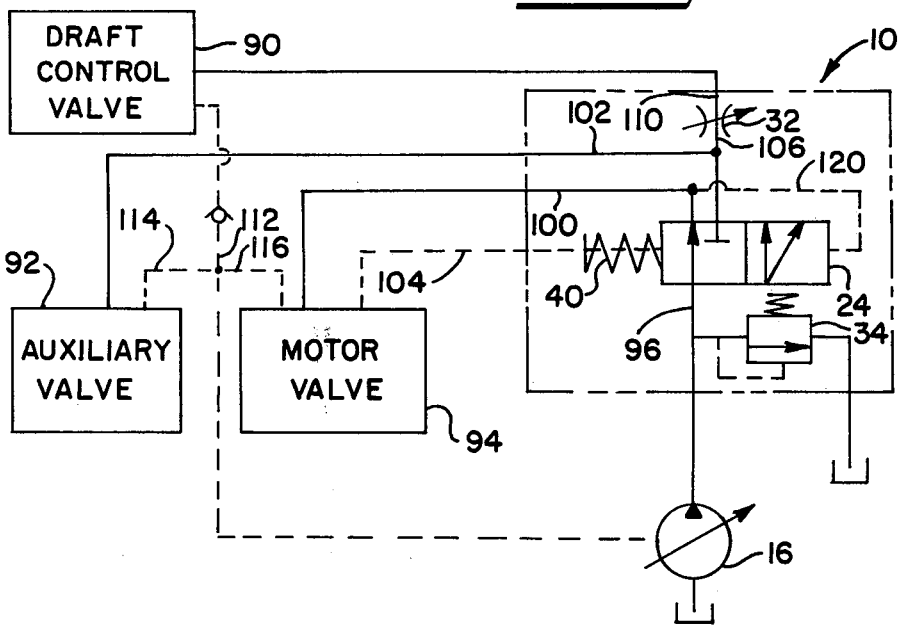
FIG. 4 is a simple hydraulic schematic in association with related tractor hitch components.

FIG. 4 generally presents the priority valve assembly 10 having the variable orifice 32, the priority valve spool 24 with its spring 40 and the high pressure relief valve 34. The variable displacement pump 16, which includes a compensator system, is shown, as are representative indications of the draft control valves 90, the auxiliary valve 92 and the motor valve 94. Various flow lines and signal lines connect the components.

The internal passages of the priority valve assembly as shown by FIGS. 1 and 4, include the pump source passage 96, the motor valve passage 100, the auxiliary valve passage 102, the motor valve signal line passage 104, the variable orifice source passage 106 and the variable orifice delivery passage 110. FIG. 4 also includes three signal lines 112, 114, and 116 emanating from the draft control valve, the auxiliary valve and the motor valve respectively and connected to the variable displacement pump.

OPERATION

One function of the priority valve assembly is to give fluid flow priority to the motor valve with the auxiliary valve and the draft control valve secondary priority. In FIG. 1 the motor valve is receiving all the fluid delivered by the variable displacement pump. The pump is always developing a 300 psi standby pressure such that when the motor valve is open this minimum 300 psi pressure will cause the priority valve spool 24 to maintain its position as shown in FIG. 1 allowing fluid flow from the pump source passage 96 to the motor valve passage 100 thence onto the motor valve to satisfy the demand.

If no demand exists at the motor valve but demand does exist at the auxiliary valve the priority valve spool 24 will be shifted downwardly (FIG. 1) such that communication is open between the pump source passage 96 and the auxiliary valve passage 102, thence to the auxiliary valve as demand dictates. The priority valve spool is shifted as the pump compensates for the increased demand by the auxiliary valve. The increase delivery pressure provided by the pump will pass through signal passage 120 thus shifting the priority valve to a position allowing flow to the auxiliary valve. Note that in this position fluid may pass to the motor valve, which has priority due to the pressure augmentation of the spring 40, as well as to the auxiliary valve. If an increased demand is received for the motor valve the pump will compensate to its maximum stroke and then if necessary the priority valve will cut off flow to the auxiliary valve to satisfy the needs of the motor valve.

When the auxiliary valve may receive fluid from the pump the draft control valve may also receive fluid flow since variable orifice source passage 106 connects the auxiliary valve passage 102 to the variable orifice 32 and the variable orifice delivery passage 110. Again the motor valve will take preference over the draft control valve.

The variable orifice 32 acts as a raise rate control device to control the lifting rate of the tractor hitch. The greater the area of the opening the faster the hitch will rise as more fluid will be passing to the hitch control valve. As stated earlier the raise rate can be controlled independently from inside the cab but will also be automatically adjusted to allow increased flow when the overriding draft position control lever is set at a position to rapidly raise the attached implement, generally a "full raise" position.

The variable orifice 32 is always open a minimum amount and it is adjustable by adjusting the screw 64.

The variable orifice 32 also acts as a controlling member for the load sensing pump. A pressure drop across the variable orifice, initiated by the opening of the draft control valve, is communicated to the compensated variable displacement pump through signal line 112.

Thus, it can be seen that a priority valve assembly having the objects and advantages set forth above is provided by the invention. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an agricultural tractor having a hydraulically operated hitch control system including a position control valve, a motor valve, an auxiliary valve, a motor priority valve incorporating a variable raise rate device and a compensator adjusted variable displacement pump the priority valve assembly comprising:

a housing having a plurality of internal passages and ports including a fluid input port for receiving fluid from said variable displacement pump, a pump source passage with access to said fluid input port, a motor valve passage connected to said pump source passage, a motor valve delivery port accessing said motor valve passage to said motor valve, an auxiliary valve passage connected to said pump source passage, an auxiliary valve delivery passage accessing said auxiliary valve delivery passage to said auxiliary valve, a motor valve signal line passage connected to said motor valve, a variable orifice source passage connected to said auxiliary valve delivery passage and a variable orifice delivery passage connecting said variable orifice source passage to said draft control valve;

a priority valve spool having a multi-diameter body with a smaller diameter portion between larger diameter end portions, said priority valve spool spring and pressure biased to a first position and pressure biased to a second position, said priority valve spool being in said first position when said variable displacement pump is pumping fluid at an unrestricted rate to said motor valve passage and said priority valve spool being in said second position when said variable displacement pump is pumping fluid at a rate greater than the rate of fluid flowing through said motor valve passage;

a variable orifice interposed between said variable orifice source passage and said variable orifice delivery passage, incuding a rotary metering valve having an edge that may be rotated across an orifice connecting said variable orifice source passage with said variable orifice delivery passage to increase the area of said orifice, said variable orifice being mechanically adjustable through linkage means mounted on said rotary metering valve.

2. The invention in accordance with claim 1 wherein said priority valve assembly further comprises a relief valve interposed between said pump source passage and a passage to a reservoir, said relief valve acting to relieve fluid pressure in said pump source passage when said pressure approaches the maximum pressure that can be developed by said variable displacement pump.

* * * * *